US006746350B2

(12) United States Patent
Hartman et al.

(10) Patent No.: US 6,746,350 B2
(45) **Date of Patent: *Jun. 8, 2004**

(54) PRACTICE HOCKEY PUCK

(76) Inventors: Michael J. Hartman, 8713 Woodmere Crossing La., Charlotte, NC (US) 28226; Arthur Kleinpell, 475 N. Cranbrook Rd., Bloomfield Hills, MI (US) 48301; Richard Allen Hartman, 8713 Woodmere Crossing La., Charlotte, NC (US) 28226

( * ) Notice: Subject to any disclaimer, the term of this patent is extended or adjusted under 35 U.S.C. 154(b) by 0 days.

This patent is subject to a terminal disclaimer.

(21) Appl. No.: 10/428,538

(22) Filed: May 2, 2003

(65) Prior Publication Data

US 2003/0195067 A1 Oct. 16, 2003

Related U.S. Application Data

(63) Continuation of application No. 09/836,098, filed on Apr. 17, 2001, now Pat. No. 6,638,188.

(60) Provisional application No. 60/224,296, filed on Aug. 10, 2000, and provisional application No. 60/201,962, filed on May 5, 2000.

(51) Int. Cl.[7] ..... A63B 71/02

(52) U.S. Cl. ..... 473/588; 473/446

(58) Field of Search ..... 473/588, 589, 473/446, 471

(56) References Cited

U.S. PATENT DOCUMENTS

| | | | | | |
|---|---|---|---|---|---|
| 4,153,253 | A | * | 5/1979 | White, Sr. | 40/327 |
| 5,284,343 | A | * | 2/1994 | Bigornia et al. | 473/446 |
| 5,718,648 | A | * | 2/1998 | La Savio | 473/588 |
| 5,733,213 | A | * | 3/1998 | Colarusso | 473/588 |
| 5,792,012 | A | * | 8/1998 | Dudley | 473/588 |
| 5,810,682 | A | * | 9/1998 | Carruthers | 473/528 |
| 6,248,034 | B1 | * | 6/2001 | Voloshen | 473/588 |
| 6,638,188 | B2 | * | 10/2003 | Hartman et al. | 473/588 |
| 2001/0036877 | A1 | * | 11/2001 | Hartman et al. | 473/588 |

* cited by examiner

*Primary Examiner*—Raleigh W. Chiu
(74) *Attorney, Agent, or Firm*—Gifford, Krass, Groh, Sprinkle, Anderson & Citkowski, PC

(57) ABSTRACT

A practice hockey puck includes a puck body with an upper surface a lower surface and a generally flat side wall interconnecting the upper and lower surface. The lower surface of the puck body has a bore defined therein. A friction reducing cover has in inner surface and a generally flat outer surface. A connecting leg extends from the inner surface. The leg is disposed in the bore in the lower surface of the puck body so as to retain the inner surface of the puck cover adjacent to the lower surface of the puck body.

18 Claims, 1 Drawing Sheet

PRACTICE HOCKEY PUCK

REFERENCE TO RELATED APPLICATIONS

This application is a continuation of U.S. Ser. No. 09/836,098, filed Apr. 17, 2001, now U.S. Pat. No. 6,638,188 which claims priority from U.S. Provisional Patent Application Serial No.'s 60/201,962, filed May 5, 2000, and 60/224,296, filed Aug. 10, 2000, the entire contents of which are incorporated herein by reference.

FIELD OF THE INVENTION

The present invention relates generally to pucks for games such as hockey and, more specifically, to a puck for use on non-ice surfaces and a method for making the puck.

BACKGROUND OF THE INVENTION

The game of ice hockey uses a short, cylindrical puck formed of a hard rubber compound, which is propelled across the ice surface using hockey sticks. An important skill for hockey players is puck handling. Puck handling refers to the players' skill at controlling the motion of a puck using the hockey stick. Good puck handling skills require extensive training and practice. However, many hockey players spend much of their practice time training on non-ice surfaces.

A standard ice hockey puck has dramatically different performance characteristics when used on a non-ice surface. The coefficient of friction between the ice hockey puck and a non-ice surface is many times higher than between a puck and an ice surface. Therefore, the puck moves much less freely and is more likely to tumble end-over-end and behave erratically. Hockey players who wish to improve their hockey puck handling skills need the puck to perform similarly on ice and non-ice surfaces so that skills learned while practicing on a non-ice surface transfer to the ice playing field.

There have been numerous attempts to provide pucks for the play of hockey and hockey-like games on non-ice surfaces. Generally, designs for pucks for non-ice surfaces have focused on reducing the friction between the playing surface and the puck so that the puck moves more easily across the non-ice playing surface. Some attempt has also been made to provide pucks for non-ice playing surfaces that behave similarly to an ice hockey puck on an ice-playing surface so that playing skills are transferable. According to one approach, a puck-shaped game piece is provided with a variety of protrusions from the upper and lower surface of the game piece. The protrusions contact the play surface rather than the entire flat upper or lower surface contacting the play surface. This reduces the friction between the playing surface and the body of the game piece. One example of such a puck is shown in U.S. Pat. No. 5,697,858 to Lekabich. Pucks such as these do glide more easily across a non-ice playing surface than does a traditional ice hockey puck, but these pucks behave differently than a genuine ice hockey puck on an ice surface.

According to another approach, a puck includes wheels or rollers that extend from the upper and lower surfaces of the puck so as to allow the puck to roll on these wheels or rollers. Examples of this approach are shown in U.S. Pat. No. 4,801,144 to DeMasi, Jr. et al. and U.S. Pat. No. 5,518,523 to Hu et al. Once again, pucks such as these do glide more easily over a non-ice surface, but fail to provide the handling characteristics of a genuine ice hockey puck on an ice surface.

As yet another approach, a puck-shaped game piece may include a layer of friction reducing material on its upper and lower surfaces. U.S. Pat. No. 5,240,251 to Felice discloses a puck with layers of bristle material attached to the upper and lower surfaces. The bristle material includes a plurality of fabric bristles extending perpendicularly from the upper and lower surfaces such that the ends of the bristles contact the play surface. This puck design is suitable for some playing surfaces but is less suitable to other playing surfaces. Also, it provides an appearance dissimilar to a standard hockey puck and does not provide the behavior characteristics of a genuine ice hockey puck on an ice playing surface.

Another approach is shown in U.S. Pat. No. 5,692,981 to Whisman. Whisman discloses a game puck with a layer of very high molecular weight plastic glued to the upper and lower surfaces. This approach is prone to having the layers of plastic peal away from the puck body, thereby destroying the puck. Whisman also discloses an alternative approach wherein a layer of friction-reducing plastic is molded to the upper and lower surfaces of the puck body with interconnecting channels extending between the plastic layers so as to retain them on the puck body and interconnect them. This latter approach is unnecessarily difficult to mold, since the plastic must be molded onto the rest of the puck in separate step. Whisman's puck has a perimeter surface that is curved so as to encourage the puck to return to a flat orientation whenever it lands or is flipped onto its edge. This design departs from traditional puck shape and handling characteristics. An ice hockey puck has a straight vertical wall. Puck handling skills include the ability to "edge" a puck. The Whisman puck fails to provide for this. In light of the above, there remains a need for a practice hockey puck for use on a non-ice surface that has low friction and adequately duplicates the performance characteristics of a traditional hockey puck.

Sports objects such as hockey pucks are often provided as promotional items, or are marked with a logo of a team or sponsor. Traditional ice hockey pucks often have such logos or graphics disposed on their upper and/or lower surfaces. Hockey pucks for non-ice surfaces have thus far failed to address the need for a graphic displayed on an upper and/or lower surface. Therefore, there remains a need for such a display.

SUMMARY OF THE INVENTION

The present invention overcomes many of the shortcomings of the prior art by providing a practice hockey puck that has low friction when sliding across a non-ice surface and duplicates the size, shape and weight of a regulation ice hockey puck. The practice puck also duplicates the handling characteristics of an ice hockey puck, thereby allowing the player to hone their puck-handling skills on a non-ice surface and to transfer those skills to the ice-playing surface. According to one embodiment of the present invention, the practice hockey puck has a puck body with an upper and lower surface and generally flat sidewall interconnecting the upper and lower surfaces. The lower surface has a bore defined therein. A friction reducing cover has an inner surface and a generally flat outer surface. At least one connecting leg extends from the inner surface with the leg being disposed in the bore in the lower surface of the puck body so as to retain the inner surface of the cover adjacent to the lower surface of the puck body. Preferably, a second cover is provided for the upper surface of the puck body and the covers are formed from a nylon or ultra-high molecular weight plastic. These covers reduce the friction between the puck and the non-ice playing surface so that the puck glides easily thereon. Preferable, the puck body is a regulation ice hockey puck with the bores formed therein. The upper and lower covers are thin and light such that they do not affect the general appearance, size, or weight of the regulation puck. The use of a regulation puck gives the practice puck a feel and performance similar to a real puck. Preferably, a graphic is formed on the upper and/or lower surface of the puck body with the covers, which are preferably transparent, covering the graphic. The graphic may be formed by applying text or graphics to the upper or lower surface, or by positioning a piece of material with the graphic on it between the cover and the puck body.

According to one approach, a practice hockey puck according to the present invention is formed by taking a regulation hockey puck and forming bores in its upper and lower surfaces. A friction reducing cover with a plurality of legs extending therefrom is then provided and the cover is pressed onto the surface of the puck such that the legs are pressed into the bores. The legs preferably include circumferential ridges similar to a ring shank nail.

BRIEF DESCRIPTION OF THE DRAWINGS

A more complete appreciation of the invention and many of the attendant advantages thereof will be readily obtained and the invention will become better understood by reference to the following description when considered with the accompanying drawings, wherein.

DETAILED DESCRIPTION OF THE PREFERRED EMBODIMENTS

Figure 1:
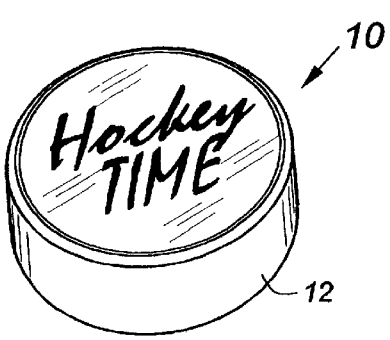
FIG. 1 is a perspective view of a practice hockey puck according to a preferred embodiment of the present invention.
Figure 2:
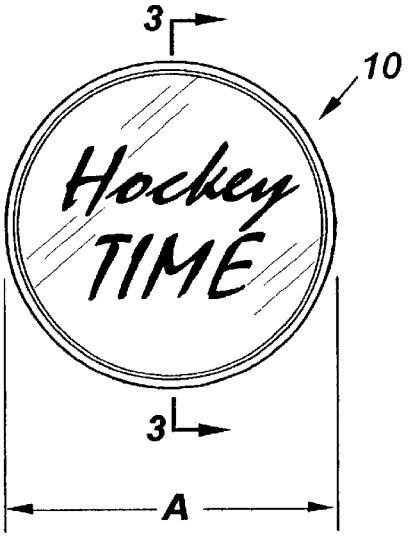
FIG. 2 is a top view of the practice hockey puck of FIG. 1.
Figure 3:
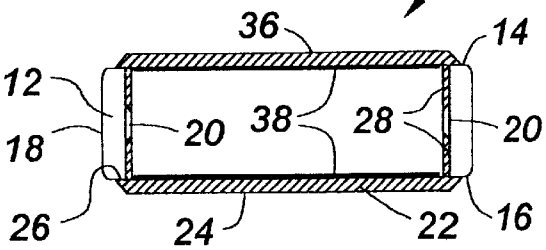
FIG. 3 is a cross-sectional view of the puck of FIG. 2 taken along lines 3—3.

Referring to FIGS. 1–3, a practice hockey puck according to the present invention is generally shown in 10. The puck 10 includes a puck body 12 which is preferably a regulation NHL and IIHL sanctioned ice hockey puck. Regulation pucks are manufactured by Viceroy in Canada, Guffex in the Czechoslovakian Republic and Vegum in Slovakia. These pucks have a diameter of three inches, a thickness of one inch and weigh 5½ to 6 ounces. Alternatively, the puck may be a weighted 10 ounce puck with the same dimensions as a regulation puck. Other weights may also be used. The pucks are formed of a hard rubber compound. The puck body has an upper surface 14, a lower surface 16 and a generally cylindrical side wall 18 that extends between the upper and lower surfaces. The upper and lower surfaces of a regulation hockey puck are smooth and parallel to one another and the cylindrical side surface 18 is perpendicular to the upper and lower surfaces. According to the present invention, the regulation puck that forms the puck body 12 has a plurality of bores 20 formed in the upper 14 and lower 16 surface of the puck body 12. The bores in the upper and lower surfaces may be aligned and extend entirely through the body 12, as shown in FIG. 3, or may alternatively extend only a portion of the way through the body.

Figure 4:
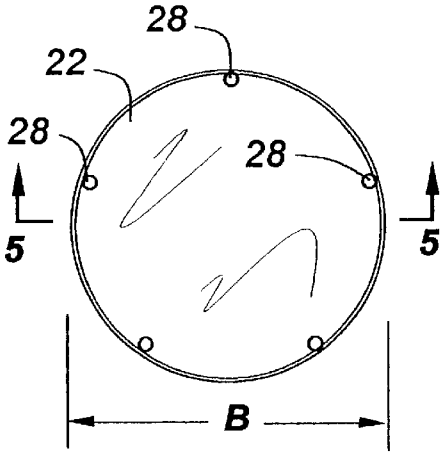
FIG. 4 is a bottom plan view of a friction reducing cover which forms part of the puck of FIGS. 1–3.
Figure 5:
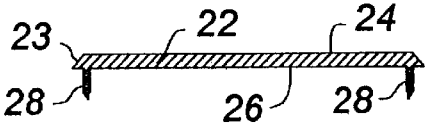
FIG. 5 is a cross-sectional view taken of FIG. 4 taken along lines 5—5.

In order to reduce the sliding friction of the puck 10 on a non-ice surface, a friction reducing lower cover 22 is attached to the lower surface 16 of the puck body 12. The cover 22 is preferably disc-shaped with a thickness of approximately 1/16 of an inch. The cover 22 preferably has a diameter slightly less than the diameter of the puck body 12. Details of the lower cover 22 are shown in FIGS. 4 and 5. In one embodiment, the outer perimeter of the disc 22 has a bevel 23 with a width of between 1/8 and 3/16 of an inch. The outermost diameter of the cover 22, as shown at B in FIG. 4, is 27/16 inches in one embodiment. Alternatively, the cover 22 may have a larger or smaller diameter or the bevel may be formed differently. The cover 22 has an outer surface 24 and an inner surface 26. A plurality of connecting legs 28 extend from the inner surface 22. These legs 28 align with the bores 20 in the body 12 such that when the legs 28 are forced into the bores 20, the cover 22 is retained with its inner surface 24 adjacent to the lower surface 16 of puck body 12. The outer surface 24 of the cover 22 is preferably substantially flat, without any nubs or projections. This provides and appearance most similar to a traditional hockey puck.

Figure 6:
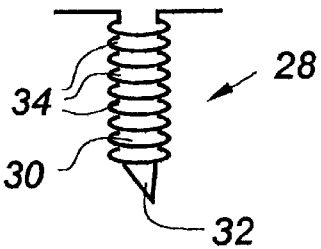
FIG. 6 is a detailed view of one connecting leg of the cover of FIG. 5.

A detail of one connecting leg 28 is shown in FIG. 6. The leg 28 has a cylindrical shaft 30 with a pointed end 32. A plurality of circumferential ribs 34 are preferable formed on the shaft 30. Theses ribs, similar to the ribs on a ring shank nail, help retain the legs 28 in the bores 20. The bores 20 and legs 28 are sized so as to provide a tight and secure interconnection. As will be clear to those of skill in the art, the bores 20 and legs 28 may have other than a circular cross-section and the end of each leg may be pointed in a different manner than shown, may be unpointed, or may have a rounded end. The shape of the legs 28 avoids the need for an adhesive to retain the cover, though an adhesive may be used.

An upper cover 36 is preferably identical to the lower cover 24 and interconnected with the puck body 12 in the same manner. The upper and lower covers 22 and 36 are preferably injection molded of a friction reducing material such as nylon, polyethylene, polyurethane, or polycarbonate or any of several ultra-high molecular weight (UHMW) plastics, including UHMW polyethylene, polyurethane, or polycarbonate as known to those of skill in the art. Most preferably, the covers 22 and 36 are formed of a substantially transparent plastic. This leads to another aspect of the present invention. The present invention may be used to provide a practice hockey puck with a promotional message thereon. Specifically, a graphic may be provided on the upper and/or lower surface of the puck body 12 and be covered and protected by the upper and/or lower covers. For example, in FIG. 1, the text "Hockey Time" is shown on the upper side of the puck 10. Because of the covers 22 and 36 are preferably transparent, the graphic may be placed directly on the upper or lower surface of the puck body 12 and be visible through the cover. As used herein, the term graphic is defined to mean text or any image which is formed on the upper or lower surface on the puck body or placed on a piece of material placed between the puck body and the cover. In FIG. 3, a piece of graphic material 38 is positioned on the upper and lower surfaces of the puck body 12 and trapped into place once the covers 22 and 36 are pressed into place. The graphic material 38, including a graphic displayed through the covers, may be a sticker, paint, or any other material that supports a graphic, with a graphic formed in any way known by those with skill in the art. For example, the graphic materials are preferably waterproof labels formed of vinyl or PVC with the graphic printed thereon using silk screening or ink printing. The labels may have an adhesive, such as pressure sensitive adhesive, thereon or may be held in place only by the cover. A graphic may also be applied directly to the inner surfaces of the covers, such as by painting or printing so as to be visible through the covers. Preferable, pieces of graphic material 38 are used so that different practice pucks may be formed with different graphics as desired. For example, if a sponsor wishes to distribute practice hockey pucks with their emblem thereon, graphic materials may be provided or created and used in the assembly of the puck 10 according to the present invention.

According to one approach to forming the present invention, a regulation hockey puck has bores formed in its upper and lower surface. Friction reducing covers as previously described are then provided. Graphics may be positioned on the upper and/or lower surfaces of the puck body and then the covers are pressed into place, such as by using a small press. Preferably, the graphic material is shaped and sized such that installation of the cover self-centers the material. The configuration of the connecting legs securely locks the covers in place, thereby protecting the graphics. The graphic material 38 is preferably disc shaped with a diameter smaller than the diameter between the legs 28, but may be other sizes and shapes.

As illustrated, the upper and lower covers of the puck 10 include five connecting legs each with the legs arranged around the perimeter of the cover. This is a preferred positioning, though other numbers of legs may be used. Alternatively, the legs may be positioned in a different configuration.

The outer surface 24 of the cover 22 is preferably substantially flat, without any nubs or projections. This provides an appearance most similar to a traditional hockey puck.

As will be clear to those of skill in the art, the described embodiments of the present invention may be altered in various ways without departing from the scope or teaching of the present invention. For example, the puck may be made larger or smaller, depending on the application. Also, a puck could be formed with a friction reducing cover only on one of the upper or lower surfaces, if so desired. Other modifications will also be clear to those of skill in the art. It is the following claims, including all equivalents which define the scope of the present invention.

We claim:

1. A practice hockey puck comprising:

a puck body having an upper surface, a lower surface, and a generally flat side wall interconnecting the upper and lower surfaces;

a substantially transparent friction reducing cover having an inner surface and a generally flat outer surface, the inner surface being disposed adjacent the lower surface of the puck body;

at least one connector interconnecting the cover with the puck body, the connector extending into the lower surface and the puck body so as to retain the inner surface of the cover adjacent the lower surface of the puck body.

2. The practice hockey puck according to claim 1, further comprising a second friction reducing cover having an inner surface and a generally flat outer surface, the inner surface of the second cover being disposed adjacent the upper surface of the puck body, at least one connector interconnecting the second cover with the body, the connector extending into the upper surface and the puck body so as to retain the inner surface of the cover adjacent the upper surface of the puck body.

3. The practice hockey puck according to claim 1, wherein the at least one connector comprises a plurality of connectors each extending into the lower surface and the puck body.

4. The practice hockey puck according to claim 3, wherein the cover has a perimeter, the plurality of connectors being disposed adjacent the perimeter.

5. The practice hockey puck according to claim 1, wherein the connector includes a shaft with a plurality of ribs extending outwardly therefrom.

6. The practice hockey puck according to claim 1, further comprising a graphic disposed between the cover and the puck body.

7. The practice hockey puck according to claim 1, wherein the puck body has an outer perimeter with a diameter, the cover being disc shaped and having a diameter smaller than the diameter of the puck body.

8. The practice hockey puck according to claim 1, wherein the cover is disc shaped and has a beveled edge.

9. The practice hockey puck according to claim 1, wherein the puck body comprises a regulation hockey puck having a thickness of one inch, a diameter of 3 inches, and a weight of approximately 5½ to 6 ounces, the puck body being formed of a hard rubber compound.

10. The practice hockey puck according to claim 9, wherein the cover is disc shaped and has a diameter of approximately 2 7/16 inches.

11. The practice hockey puck according to claim 1, wherein the puck body weighs approximately 10 ounces.

12. The practice hockey puck according to claim 1, wherein the cover is formed of a material chosen from the group consisting of nylon and ultra high molecular weight plastics.

13. A practice hockey puck comprising:

a generally cylindrical puck body having a generally flat upper surface, a generally flat lower surface parallel to the upper surface, and a generally cylindrical side wall interconnecting the upper and lower surfaces, the side wall being perpendicular to upper and lower surfaces, the upper and lower surfaces each having a plurality of bores defined therein;

a substantially transparent friction reducing upper cover having an inner surface and a generally parallel outer surface, the outer surface being substantially flat, the inner surface of the upper cover being disposed adjacent the upper surface of the puck body;

a first plurality of connectors interconnecting the upper cover with the puck body, each connector extending into the upper surface and the puck body so as to retain the inner surface of the upper cover adjacent the upper surface of the puck body;

a substantially transparent friction reducing lower cover having an inner surface and a generally parallel outer surface, the outer surface being substantially flat, the inner surface of the lower cover being disposed adjacent the lower surface of the puck body; and a second plurality of connectors interconnecting the lower cover with the puck body, each connector extending into the lower surface and the puck body so as to retain the inner surface of the lower cover adjacent the lower surface of the puck body;

wherein the puck body is formed of a hard rubber and the upper and lower surfaces are formed of a plastic selected from the group consisting of nylon and ultra high molecular weight plastics.

14. A practice hockey puck comprising:

a generally cylindrical puck body having a circular upper surface, a circular lower surface, and a generally flat side wall interconnecting the upper and lower surfaces, the lower surface having a graphic disposed thereon; and a substantially transparent friction reducing cover having an inner surface and an outer surface, the cover being disposed adjacent the lower surface of the puck body so as to cover and protect the graphic on the lower surface of the puck body.

15. The practice hockey puck according to claim 14, wherein the cover covers substantially all of the lower surface.

16. A method of converting an ice hockey puck into a practice puck for use on a non-ice surface, comprising the steps of:

providing an ice hockey puck comprising a solid generally cylindrical hard rubber puck body having an upper surface and a parallel lower surface interconnected by a generally flat side wall;

providing a substantially transparent friction reducing cover; and attaching the cover to the lower surface of the hockey puck such that the inner surface of the cover is retained adjacent the lower surface of the ice hockey puck.

17. The method according to claim 16, further comprising the step of providing a plurality of connectors, and the attaching step comprising using the connectors to attach the cover to the lower surface.

18. The method according to claim 16, further comprising the steps of:

providing a graphic; and disposing the graphic on the lower surface of the ice hockey puck prior to the pressing step.

* * * * *